US008465186B2

(12) United States Patent
Michalak et al.

(10) Patent No.: US 8,465,186 B2
(45) Date of Patent: Jun. 18, 2013

(54) MOISTURE RESISTANT COATINGS FOR POLYMERIC ENCLOSURES

(75) Inventors: Chris S. Michalak, Elkton, MD (US); Dave DeGuiseppi, Chadds Ford, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 473 days.

(21) Appl. No.: 12/403,696

(22) Filed: Mar. 13, 2009

(65) Prior Publication Data

US 2010/0232167 A1 Sep. 16, 2010

(51) Int. Cl.
*F21V 29/00* (2006.01)
*F21V 5/00* (2006.01)

(52) U.S. Cl.
USPC ..... 362/520; 362/547; 362/267

(58) Field of Classification Search
USPC ..... 362/267, 362, 547; 359/507; 427/106, 427/162; 96/108; 95/107; 34/467
See application file for complete search history.

(56) References Cited

U.S. PATENT DOCUMENTS

| | | | | |
|---|---|---|---|---|
| 4,612,607 | A * | 9/1986 | Segoshi et al. | 362/547 |
| 5,117,343 | A * | 5/1992 | Kerscher et al. | 362/297 |
| 5,806,957 | A * | 9/1998 | Prior et al. | 362/459 |
| 6,179,456 | B1 | 1/2001 | Nakamura et al. | |
| 6,196,708 | B1 * | 3/2001 | Rogers | 362/547 |
| 6,226,890 | B1 * | 5/2001 | Boroson et al. | 34/472 |
| 6,454,449 | B2 * | 9/2002 | Nestell et al. | 362/520 |
| 6,520,650 | B2 | 2/2003 | Fraizer | |
| 6,709,493 | B2 | 3/2004 | DeGuiseppi et al. | |
| 7,217,314 | B2 * | 5/2007 | DeGuiseppi et al. | 95/117 |
| 7,858,171 | B2 * | 12/2010 | Kawashima et al. | 428/212 |
| 2005/0157514 | A1 * | 7/2005 | Brinkmann | 362/547 |
| 2006/0150817 | A1 | 7/2006 | DeGuiseppi et al. | |

FOREIGN PATENT DOCUMENTS

| | | |
|---|---|---|
| EP | 0 816 043 | 1/1998 |
| GB | 2 344 876 | 6/2000 |

* cited by examiner

*Primary Examiner* — Peggy A. Neils
(74) *Attorney, Agent, or Firm* — Richard W. Ellis

(57) ABSTRACT

A moisture resistant housing assembly is provided, the housing defining an internal space and an ambient space surrounding said internal space, the housing constructed at least partially of a polymeric material and a moisture barrier layer covering a portion of the polymeric material, the moisture barrier layer having a moisture permeation coefficient that is lower than the moisture permeation coefficient of the polymeric material.

16 Claims, 3 Drawing Sheets

Desiccant Life

MOISTURE RESISTANT COATINGS FOR POLYMERIC ENCLOSURES

BACKGROUND OF THE INVENTION

Excessive moisture causes damage within many electronic enclosures such as lighting assemblies or electronic control units. For instance, electrical and electronic devices may be ruined due to excessive moisture within an enclosure. Examples of lighting assemblies which are subject to undesirable moisture include, for example, automotive headlamp units and other outdoor lighting assemblies where on/off cycling of a lamp within the enclosure results in moisture build-up. As used herein, the term "moisture" is intended to refer to water that is diffused or condensed, whether in liquid form or vapor form, from the ambient atmosphere.

The problem of moisture build up within enclosures is particularly acute in enclosures having polymeric components. For example, modern vehicle head lamps, brake lamps, running lamps, turn signal lamps, fog lamps, back-up lamps and parking lamps (collectively "lamps" or "vehicle lamps") typically have one or more light bulbs located in an enclosed polymeric housing. It is critical to the effective operation of the lamp to prevent water, dirt, oils and the like from reaching the bulbs, the reflective surfaces, the lens or the housing. However, thermal cycling due to bulb operation, changes in the environment, and vehicle operation can cause moisture to condense on the interior of the housing or lens and inhibit light output from the lamp. Components within a lamp may be damaged by such condensation. Similar problems may arise in other electronic enclosures, such as electronic control units. Moisture buildup or condensation can contribute to corrosion, short circuits and the like.

The air outside of a lamp housing may be below the water vapor saturation point, and ambient air directed to flow through the housing may therefore have the capacity to remove condensation from the lamp housing by removing water vapor from the housing. Accordingly, one known means of reducing moisture related problems in automotive lamps is to use a vent to disperse moisture by providing greater airflow across or through the enclosure. Such vent systems attempt to reduce condensation by employing some means of increasing airflow through the lamp housing. However, it can be very difficult to provide sufficient airflow to reduce moisture condensation, because increasing the vent opening sizes can exacerbate problems such as contamination, etc. Many vent systems attempt to increase airflow by having vent openings in more than one location. The openings must often be placed in specific locations where airflow past the vent opening enhances airflow through the housing. Location of these vent systems may have a negative effect on other aspects of lamp performance.

Another means of reducing moisture in an enclosure is to place a drying agent or desiccant within the enclosure. Desiccants can operate by several fundamental mechanisms including absorption, adsorption, and reaction. Absorption occurs when a substance (e.g., water vapor) penetrates the inner structure of another (the absorbent). Adsorption occurs when a substance (e.g., water vapor) is attracted and held onto the surface of another (the adsorbent). Reaction occurs when the substance (e.g., water vapor) reacts with the desiccant to form a chemical bond with water. As the terms "desiccants" or "drying agents" are used herein, they are intended to refer to any material which absorbs, adsorbs, or reacts with water vapor from the air and is thereby able to reduce the moisture in the air within a lighting enclosure.

Many desiccants will desorb or release adsorbed or absorbed moisture when heated in a process called regeneration. Such desiccants are commonly referred to as regenerating desiccants. In contrast, non-regenerating desiccants retain adsorbed, absorbed, or reacted moisture when heated.

Moisture permeation through polymeric components of electronic enclosures contributes significantly to condensation problems in such enclosures. For example, many lighting enclosures are constructed of two polymer components. A opaque portion may be polypropylene and make up a significant portion of the total enclosure area. Lens components, which may be constructed of clear or substantially clear polycarbonate, have relatively high moisture permeation coefficients.

SUMMARY OF THE INVENTION

A moisture resistant housing assembly is provided, the housing defining an internal space and an ambient space surrounding said internal space, the housing having a polymeric material case and a moisture barrier layer covering a portion of the polymeric material, the moisture barrier layer having a moisture permeation coefficient that is lower than the moisture permeation coefficient of the polymeric material.

DETAILED DESCRIPTION OF THE INVENTION

The present invention relates to apparatus and methods to reduce moisture permeation in electronic enclosures having polymeric components. Specifically, a layer that reduces the moisture permeability of polymeric components such as a lens or case is provided. The layer may be applied to the inside or outside of the polymeric lamp component. The invention has application in, for example, outdoor lighting, decorative lighting, automobile, truck, motorcycle and boat lamps, as well as other vehicle lamps, lighting applications, electronic and other enclosures where condensation is problematic.

Figure 1:
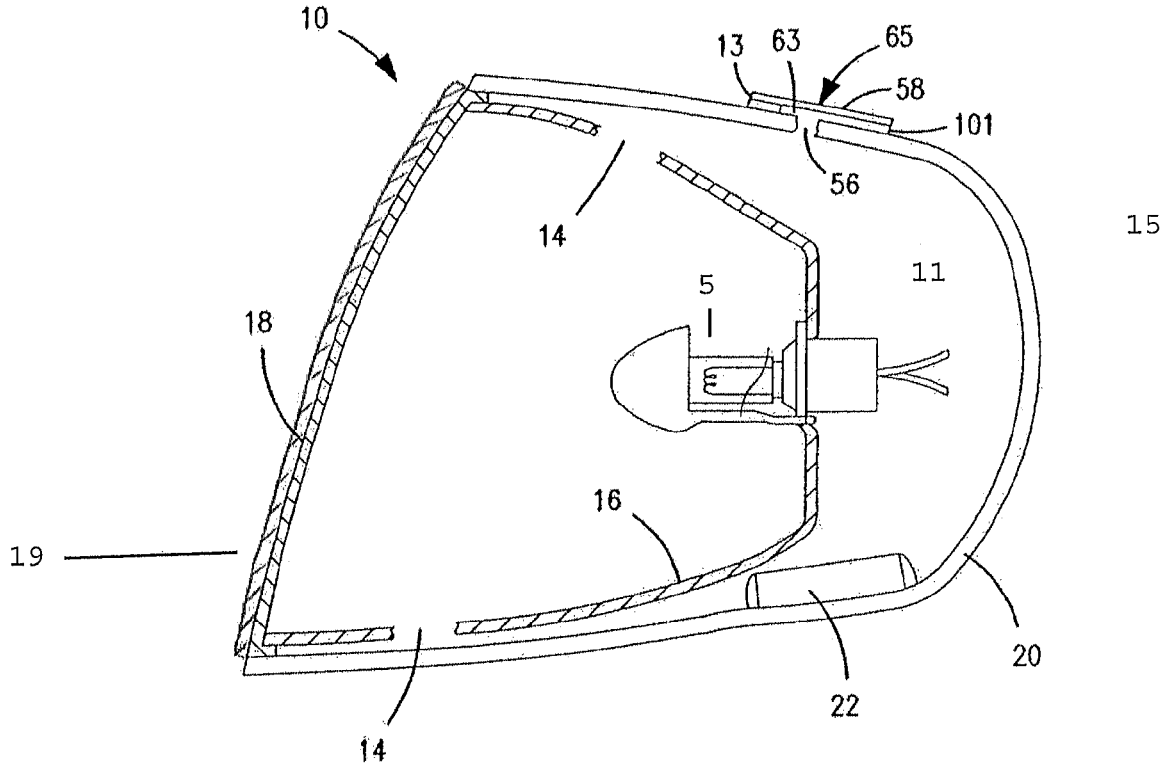
FIG. 1 is a cross section of a lamp enclosure containing a desiccant and an adhesive diffusion tube mounted on the outside of the housing.

The lighting assembly depicted in FIG. 1 includes a light source 5 enclosed in a housing 10. The housing may be constructed of at least two components. The first component may be a lens portion, the second component may be a case. The housing defines an internal space 11 from the ambient space 15 surrounding it. A desiccant 22 may be installed within the housing to absorb moisture from the internal space. A diffusion tube 65 is optionally positioned within the housing to provide a pathway for pressure equilibration between the internal space and the ambient space. The illustrated diffusion tube may minimize moisture transport into the lighting assembly, however pressure equilibration may be accomplished through a vent or other means. The housing includes a transparent lens 16. The lens includes a moisture barrier layer 19 covering at least one surface of the lens. The moisture barrier layer may be in the form of a coating or a film disposed upon the lens. A moisture barrier layer may be applied to a surface of case 20 (not shown).

The case may include a reflective portion and other components of the lighting assembly such as bulbs, wiring, etc. The case may be molded in a manner known in the art. Suitable materials for the case include polypropylene, ABS, and Talc filled or glass filled Nylon or Polypropylene or ABS.

The lens may be constructed of polymeric material. Typically, the lens is substantially transparent or clear, but the lens material may contain additives which provide some tint or color. Polymeric lenses are known to be constructed of polycarbonate or PMMA. Preferably, the lens is constructed of a polycarbonate material. Other lens materials may be chosen with due consideration to hardness, durability and compatibility with intended moisture barrier materials. The lens may be a composite material. In the case of electronic enclosures, they may be constructed of PBT, PBT-GF30, PBT-MF30, Cast Aluminum, ABS, PP, EPDM, PPS, PEEK, LDPE, HDPE, PA, ASA, PEEK and composites thereof.

A moisture barrier layer is applied to the lens and optionally to the case. As used herein, a moisture barrier layer is a layer which has a moisture permeation coefficient that is lower than that of the substrate to which it is applied. Accordingly, a moisture barrier layer may be constructed by a variety of methods and materials and may take several different forms. The moisture barrier layer may be in the form of a coating or film and may be continuous or discontinuous. To provide adequate moisture permeation resistance, a continuous coating or substantially continuous coating may be preferred.

The moisture permeation of materials is governed by Fick's Law:

$$\frac{Q}{A} = P \cdot \frac{(\Delta \partial p)}{L}$$

where:

P=moisture permeation coefficient $$\frac{Q}{A} = \text{Moisture permeation flux rate in units of Mass/Area/time}$$

L=thickness of the material

Δ∂p=water vapor partial pressure gradient across barrier layer

Using published or experimental data for moisture flux $$\frac{Q}{(A)},$$

the moisture permeation coefficient can be calculated. Preferably, the moisture barrier layer has a moisture permeation coefficient lower than that of the substrate. More preferably, the moisture barrier layer has a moisture permeation coefficient lower than that of the substrate by at least a factor of 1.5. Most preferably, the moisture barrier layer has a moisture permeation coefficient lower than that of the substrate by at least a factor of 2.

Materials for the moisture barrier layer should be selected for their moisture permeation rate, ease of application, compatibility with the substrate material and where applicable optical clarity. The moisture barrier layer may be constructed of an inorganic oxide, such as Aluminum Oxide, or Silicon Dioxide. Films of polyvinylidene chloride, ethylene vinyl alcohol, and polyethyleneteraphthalate may have application. Fluropolymer layers comprising FEP, PFA or PTFE may also be useful. Moisture barrier layers comprising Aclar® (Honeywell), Serfene™, Parylene and Aluminum Oxide are specifically described herein.

The moisture barrier layer may comprise a film applied to the exterior or interior of the substrate. The film may be adhered using a variety of methods including adhesives and fusion bonding. The moisture barrier layer may also be deposited by known methods of deposition, such as plasma deposition or vapor deposition methods. In other applications, or with certain materials, it may be desirable to apply the moisture barrier material to the substrate in liquid form such as by coating or dip coating. The coating is thereafter cured or dried to form the moisture barrier layer.

In lighting applications, the moisture barrier layer is advantageously compatible with lens coatings serving functions other than moisture permeation resistance. For example, a coating known as a hard coat may be used on the outside of the lens to improve scratch resistance. A hard coating film may be comprised of any material that is harder than the polycarbonate lens. Other coatings, which provide tint or color to the lens may also be used. Moisture barrier layer coatings may be multifunctional; they may provide, for example, scratch resistant or tinting properties as well as reducing moisture vapor permeation rate of the substrate.

Moisture barrier layer may have application in other enclosures such as electronic enclosures. Such enclosures may be constructed of PBT, PBT-GF30, PBT-MF30, Cast Aluminum, ABS, PP, EPDM, PPS, PEEK, LDPE, HDPE, PA, ASA, PEEK and composites thereof. Moisture barrier layers for such enclosures may be selected from Aclar®, Serfene™, Parylene, inorganic oxides such as $Al_2O_3$ or $SiO_2$, films made of PVDC, Ethylene vinyl alcohol or Polyethyleneterephthalate and metallized films or coatings.

The electronic enclosure may advantageously incorporate a desiccant. Desiccants may be nonregenerating, or regenerating. As used herein, "nonregenerating" with respect to desiccants means a desiccant that will not lose more than 40% of its 7-Day Moisture Absorbing Weight Gain after 48 hours of drying at 50 degrees Celsius and about 11% relative humidity. As discussed above, regenerating desiccants release moisture into the enclosure when heated and this moisture release may exacerbate condensation problems. Therefore, non-regenerating desiccants, which do not release moisture as temperature rises and relative humidity decreases, may be preferred.

In some applications, high capacity desiccants may be preferred. Preferably, the desiccant chosen will absorb at least 4 grams of water per 10 grams of desiccant when exposed to an atmosphere of 22 degrees Celsius and about 50 percent relative humidity for 7 days. More preferably, the desiccant chosen will absorb at least 5 grams of water per 10 grams of desiccant when exposed to an atmosphere of 22 degrees Celsius and 50 percent relative humidity for 7 days. Most preferably, the desiccant chosen will absorb at least 7 grams of water per 10 grams of desiccant when exposed to an atmosphere of 22 degrees Celsius and about 50 percent relative humidity for 7 days.

The desiccant may comprise an absorbent salt and can be selected, for example, from calcium chloride ($CaCl_2$), lithium chloride (LiCl), lithium bromide (LiBr), magnesium chloride ($MgCl_2$), calcium nitrate ($CaNO_3$) and potassium fluoride (KF). Other salts, such as phosphorous pentoxide ($P_2O_5$), magnesium perchlorate ($Mg(ClO_4)_2$), barium oxide (BaO), calcium oxide (CaO), magnesium oxide, (MgO), calcium sulfate ($CaSO_4$), aluminum oxide ($Al_2O_3$), calcium bromide ($CaBr_2$), barium perchlorate ($Ba(ClO_4)_2$) and copper sulfate ($CuSO_4$) may also be useful. Combinations of two or more of these salts can also be advantageously used. Other compounds can also be added to the mixture to promote chemical reactions with water. Preferably, the desiccant comprises a mixture of $MgCl_2$ and MgO. More preferably, the desiccant comprises a mixture containing at least about 20% by weight $MgCl_2$ and at least about 50% by weight MgO. Still more preferably, the desiccant comprises a mixture containing at least about 30% by weight $MgCl_2$ and at least about 40% by weight MgO. Most preferably, the desiccant comprises a mixture contains about 44% by weight $MgCl_2$ and about 56% by weight MgO.

One of skill in the art will appreciate that the amount of desiccant used in an enclosure will vary depending on the enclosure volume, the environment to which the lamp enclosure is exposed, the composition of the desiccant and other factors. Empirical methods can be readily used to determine the proper amount of desiccant.

A desiccant may be contained within the housing in any manner of moisture permeable containers or containers having moisture permeable portions. Preferably, the container is moisture vapor permeable and liquid impermeable. More preferably, the container comprises a polymeric material that is resistant to corrosion and degradation from exposure to salts and other chemicals.

The electronic enclosure may include a diffusion tube. A diffusion tube permits air pressure equalization within the enclosure, while inhibiting moisture transmission through the tube. This inhibition of moisture transmission distinguishes diffusion tubes from vents. Although both vents and diffusion tubes are used to provide air inflow and outflow from the lighting enclosure, vents allow significantly more moisture transmission than diffusion tubes.

As used herein, a "Diffusion Tube" means an device for providing fluid communication between the internal space within an enclosure and the ambient space surrounding the enclosure, which device has sufficient length, minimum cross section, tortuosity or other physical aspect to reduce the total moisture transmission through the diffusion tube.

Diffusion tubes may take a variety of forms. Appropriate configurations, length and cross sectional area for diffusion tubes will be determined with due consideration to enclosure volume, enclosure design, operating conditions, materials of construction, material thickness, surface area of the enclosure, etc. Diffusion tubes are typically designed according to the following design equation:

$$\text{Flux}=\mathscr{D}_{ab}(A/L)\{P_{ambient}-P_{enclosure}\}$$

where:

$\mathscr{D}_{ab}$=Diffusion coefficient of moisture in air

A=cross-sectional area of tube ($mm^2$)

L=tube length (mm)

$P_{ambient}$=Partial pressure of moisture in ambient environment (kPa)

$P_{enclosure}$=Partial pressure of moisture inside enclosure (kPa)

and temperature is constant.

FIG. 1 reflects an embodiment of the invention having an externally mounted adhesive diffusion tube that is created from a series of material layers. The drawing illustrates the housing wall 20 with a vent hole 56. Also shown is an externally mounted adhesive diffusion tube 65, wherein a channel 63 or pathway is cut through multiple layers to provide a diffusion path to the ambient atmosphere through hole 58 which connects the ambient atmosphere to the interior of the enclosure. An optional ePTFE vent cover (not shown) may be used to cover the hole 58 when desirable.

In some lamp enclosures, particularly large lamp enclosures, the invention may incorporate a device for reducing moisture within the lamp enclosure such as the device taught in U.S. Pat. No. 6,709,493 to DeGuiseppi et al. Such devices comprise a container for holding a desiccant, an air-impermeable, water vapor-permeable layer incorporated with said container, preferably oriented on a side adjacent a heat source, such as the lamp, a diffusion tube or channel oriented within the container to provide a pathway from the desiccant to the ambient atmosphere outside the lamp enclosure. When these devices are positioned adjacent to the bulb, the heat generated by the bulb may regenerate the desiccant. As used herein, the term "adjacent" means sufficiently close for heat from the bulb to reach the regenerating desiccant. Preferably, the device is oriented in a region of the lamp enclosure generally above the bulb so that heated air from the bulb contacts the device.

Test Methods

Desiccant Life Test

Figure 2:
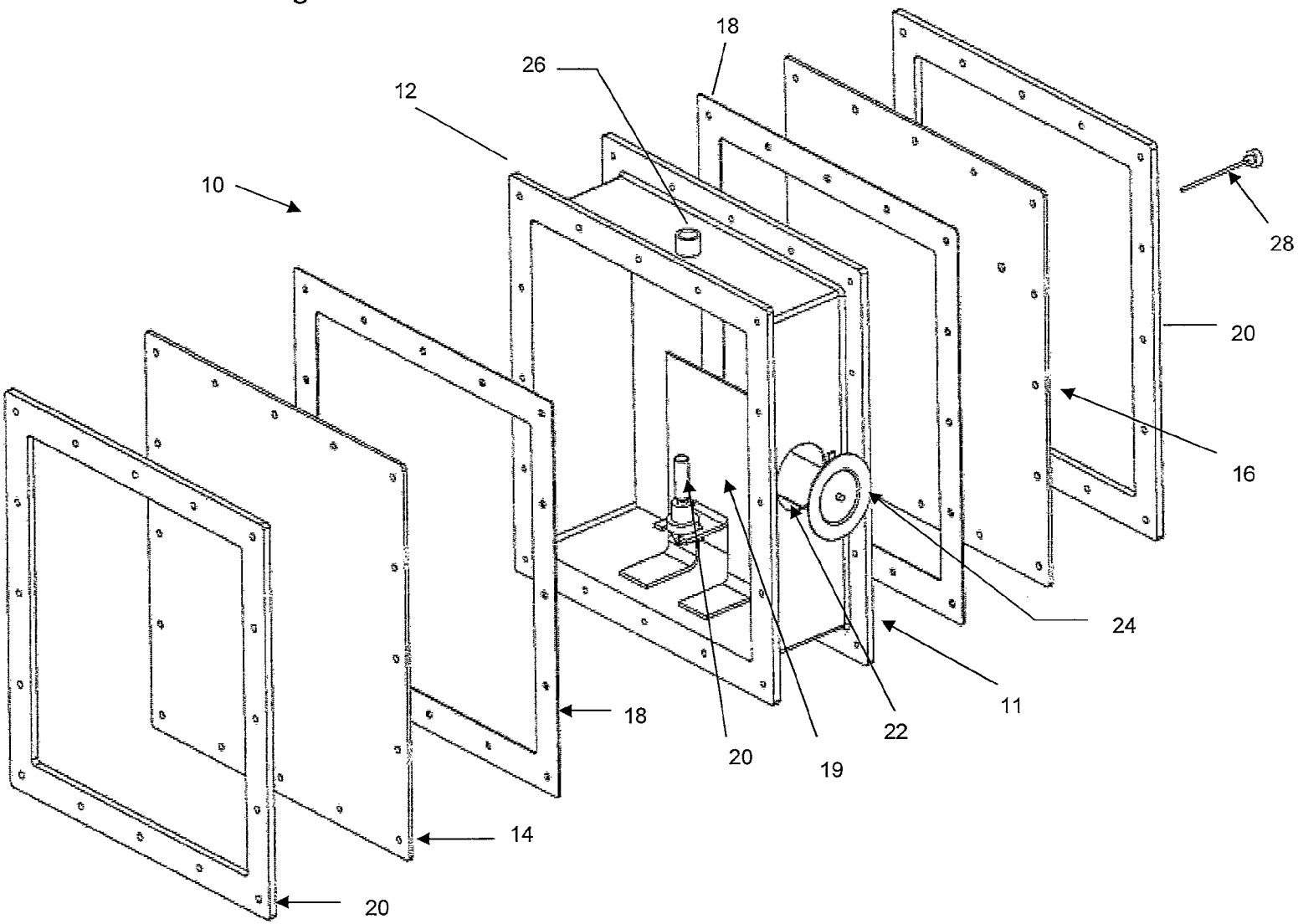
FIG. 2 depicts a test apparatus for demonstrating and evaluating moisture barrier layers.

The test fixture shown in FIG. 2 consists of a lighting enclosure 10. The enclosure dimensions were 10 inches×10 inches×3 inches. A frame 11 was constructed of Aluminum and equipped with a flange 12 around its perimeter at both ends. One side of the enclosure was constructed of a polycarbonate test plaque 14 (McMaster Carr Part No: 8574K25) to be representative of the lens. The opposite side was constructed of a polypropylene plaque 16 (McMaster Carr Part No: 8742K132) to represent the rear case of an automotive head lamp enclosure. Both plaques were fitted with and attached to the aluminum structure by means of a gasket 18 (McMaster Carr Part No: 8691 K31) and clamp plate 20. A bulb bracket 19 was used to attach a light bulb 20 to the enclosure. The enclosure was equipped with an access port 22 to allow desiccant placement. A plug 24 was provided to seal the access port. A sensor probe port 26 was provided to attach a probe for temperature relative humidity and dew point measurements. A diffusion tube 28 was fitted to the rear of the enclosure. The diffusion tube had an area to length ratio of 0.034 mm.

An environmental chamber was set at a temperature of 22 degrees Celsius and Relative Humidity (RH) of 75%. The lighting enclosure 10 was placed inside the chamber with the access port open. After 48 hours of pre-conditioning at these conditions, 5 g of desiccant, a mixture of 44 wt % $MgCl_2$ and 56 wt % MgO was placed inside the lighting enclosure and the access port was sealed. This marked the beginning of the test. The light bulb was cycled (on for 1 hour and off for 3 hours) during the entire duration of the test. The weight of moisture gained by the desiccant was measured once every 7 days using a balance (Model No: AG204, Mettler Toledo International Inc.) The test was terminated when the desiccant reached 60% of its capacity. The duration of the test was about 70 days.

Figure 3:
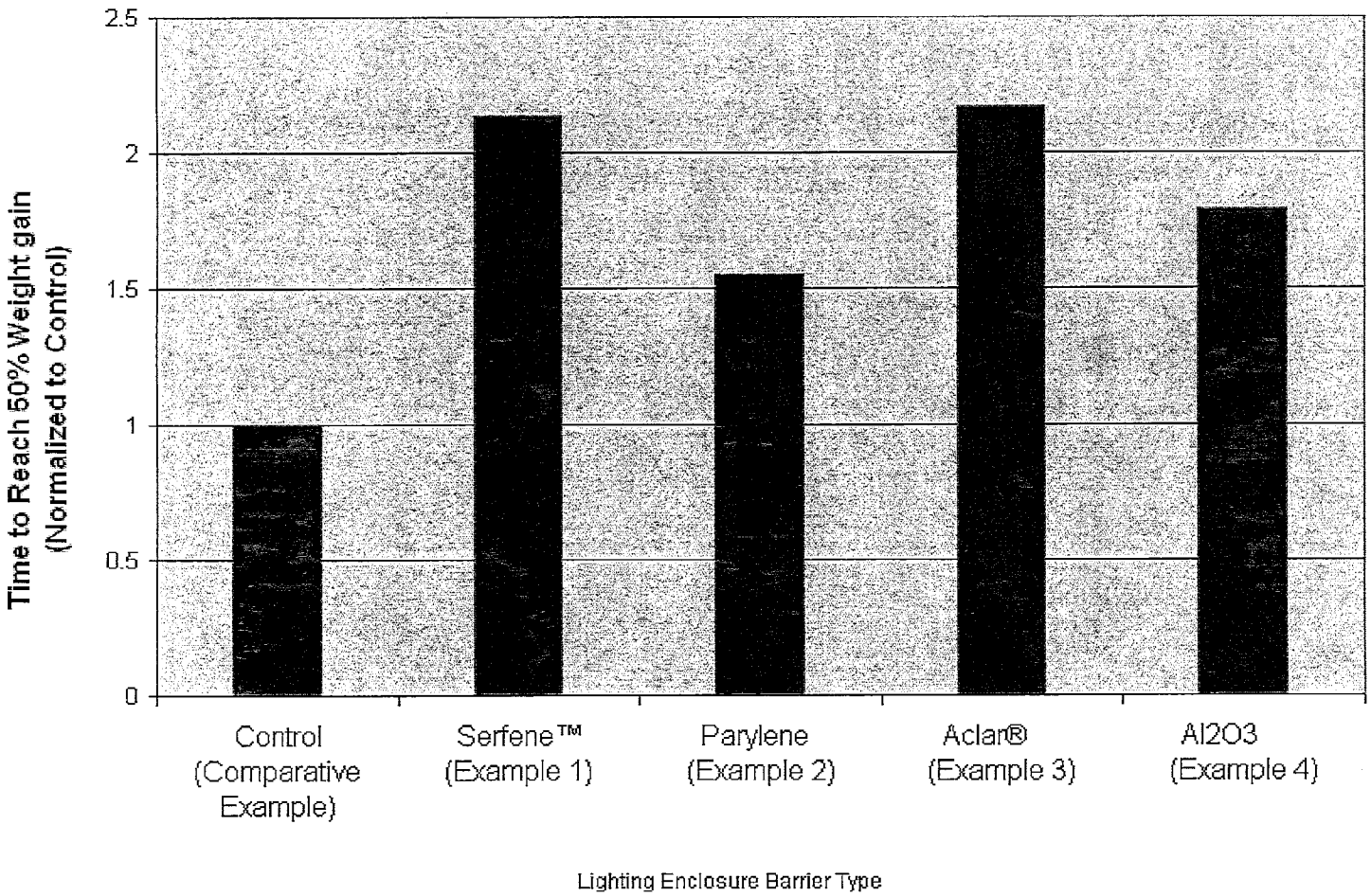
FIG. 3 is a graph depicting desiccant life using several different moisture barrier layers.

As described in the examples below, different moisture barrier layers comprising several barrier materials were applied to either the inside surface or both surfaces of a polycarbonate test plaque. FIG. 3 reflects results from the life test, illustrating the effect of the barrier material on desiccant life. Desiccant life is directly proportional to the moisture permeation rate of the polymeric components. In each example, the desiccant life improved at least by a factor of 1.5, demonstrating the efficiency of the moisture barrier layers.

EXAMPLE 1

The inside surface of the polycarbonate test plaque was roughened and dip-coated on both sides with a PVDC copolymer emulsion (Serfene™ 2022, Rohm & Haas Company). The PUDC copolymer had a moisture permeation coefficient calculated to be approximately 7.80E⁻12 ($cm^2/s \cdot Pa$). The polycarbonate substrate had a moisture permeation coefficient of 1.05E⁻10 ($cm^2/s \cdot Pa$). The plaque was allowed to dry at room temperature to form a moisture barrier layer. The layer had a thickness range from 5-30 mils. The test plaque was then attached to the lighting enclosure and subject to the desiccant life test. FIG. 3 shows that this moisture barrier layer improved desiccant life by a factor of 2.1.

EXAMPLE 2

The inside surface of the polycarbonate test plaque was coated with barrier material Parylene C (Specialty Coating Systems Inc) via vapor deposition. The Parylene C had a moisture vapor permeation coefficient of 5.2080E⁻12 ($cm^2/s \cdot Pa$). The barrier layer had a thickness of about 25 microns. The test plaque was attached to the lighting enclosure and subject to the desiccant life test. FIG. 3 shows that this moisture barrier layer improved desiccant life by a factor of 1.6.

EXAMPLE 3

A 4 mil thick film made of Aclar® (Honeywell international Inc) was adhered to the inside surface of the polycarbonate test plaque using a double sided silicone adhesive. The Aclar® had a moisture vapor permeation coefficient of 1.6E⁻13 ($cm^2/s \cdot Pa$). The test plaque was attached to the lighting enclosure and subject to the desiccant life test. FIG. 3 shows that this moisture barrier layer improved desiccant life by a factor of 2.2.

EXAMPLE 4

A composite formed of an $Al_2O_3$ vapor deposited polyester film (Part No: TPF-0599B, Tolas Health Care Packaging) was adhered to the inside surface of the polycarbonate test plaque using a double sided silicone adhesive. The $Al_2O_3$ film had a moisture vapor permeation coefficient of 1.62E⁻13 ($cm^2/s \cdot Pa$). The test plaque was attached to the lighting enclosure and subject to the desiccant life test. FIG. 3 shows that this moisture barrier layer improved desiccant life by a factor of 1.8

COMPARATIVE EXAMPLE

The polycarbonate test plaque without any barrier materials was attached to the testing enclosure and subject to the life test. Results from the test are represented as Control in FIG. 3.

Each of the moisture barrier layers increased desiccant life by at least a factor of 1.5. As desiccant life is proportional to moisture permeation rate, the moisture barrier layers all reduced the permeation rate of the substrate by a factor of at least 1.5, and in most cases a factor of 2.

What is claimed:

1. A lighting assembly comprising:

a) a lamp housing defining an internal space and an ambient space surrounding said internal space, said lamp housing comprises at least one polymeric lens and a polymeric case, the lens having a first moisture permeation coefficient;

b) light source positioned within said internal space;

c) desiccant disposed within the internal space;

d) diffusion tube having a first opening proximate to the internal space and a second opening proximate to the ambient space, said diffusion tube providing fluid communication between the internal space and the ambient space; and e) moisture barrier layer disposed upon said lens, the moisture barrier having a second moisture barrier coefficient, wherein the second moisture barrier coefficient is less than the first moisture barrier coefficient.

2. The lighting system of claim 1 in which said moisture barrier layer is a coating.

3. The lighting system of claim 1 in which said moisture barrier layer is a film.

4. The lighting system of claim 1 in which said moisture barrier layer is optically clear.

5. The lighting system of claim 1 in which, said desiccant is a high capacity desiccant disposed within the internal space, said desiccant being nonregenerating at temperatures up to about 50C and about 11% RH.

6. A lighting assembly comprising:

a) a lamp housing defining an internal space and an ambient space surrounding said internal space, said lamp housing comprising at least one polymeric lens and a polymeric case, the lens having a first moisture permeation coefficient;

b) light source positioned within said internal space; and c) moisture barrier layer disposed upon at least the polymeric lens of said lamp housing, the moisture barrier having a second moisture permeation coefficient, wherein the second moisture permeation coefficient is less than the first moisture permeation coefficient.

7. The lighting assembly of claim 6, wherein said polymeric lens comprises polycarbonate.

8. The lighting assembly of claim 6, wherein said moisture barrier layer is in the form of a coating or a film disposed on said lens.

9. The lighting assembly of claim 6, wherein said moisture barrier layer is adjacent to said polymeric lens.

10. The lighting assembly of claim 6, wherein said moisture barrier layer comprises Aluminum dioxide.

11. The lighting assembly of claim 6, wherein said moisture barrier layer comprises PVDC.

12. A lens for use in a housing that defines an internal space, the lens comprising a polymeric lens material and a moisture barrier layer covering the lens, the moisture barrier layer being in the form of a coating or a film disposed on the lens, and the lens material having a first moisture vapor permeation coefficient that is greater than a second moisture vapor permeation coefficient of the moisture barrier layer.

13. The lens of claim 12 in which the moisture barrier layer comprises Aluminum Oxide.

14. The lens of claim 12 in which the moisture barrier layer comprises PVDC.

15. The lighting assembly of claim 6, wherein said second moister permeation coefficient is less than the first moisture permeable coefficient by at least a factor of 1.5.

16. The lens of claim 12, wherein said second moister permeation coefficient is less than the first moisture permeable coefficient by at least a factor of 1.5.

* * * * *